US011519186B2

(12) United States Patent
Haeberle et al.

(10) Patent No.: US 11,519,186 B2
(45) Date of Patent: Dec. 6, 2022

(54) SUPPORT STRUCTURE FOR A FRAME FORMWORK PANEL

(71) Applicant: PERI SE, Weissenhorn (DE)

(72) Inventors: Wilfried Haeberle, Langenau (DE); Alexander Hieber, Neu-Ulm (DE); Stig Kirchhoff, Bellenberg (DE)

(73) Assignee: PERI SE, Weissenhorn (DE)

( * ) Notice: Subject to any disclaimer, the term of this patent is extended or adjusted under 35 U.S.C. 154(b) by 0 days.

(21) Appl. No.: 16/827,437

(22) Filed: Mar. 23, 2020

(65) Prior Publication Data

US 2020/0332538 A1 Oct. 22, 2020

(30) Foreign Application Priority Data

Mar. 22, 2019 (DE) ..... 10 2019 107 436.3

(51) Int. Cl.
*E04G 9/02* (2006.01)
*E04G 9/06* (2006.01)
*E04G 11/50* (2006.01)

(52) U.S. Cl.
CPC ..... *E04G 9/02* (2013.01); *E04G 9/06* (2013.01); *E04G 11/50* (2013.01); *E04G 2009/025* (2013.01); *E04G 2009/026* (2013.01)

(58) Field of Classification Search
CPC ..... E04G 9/04; E04G 9/06; E04G 2009/025; E04G 2009/026; E04G 2009/028; E04G 2009/023; E04G 11/482; E04G 11/486; E04G 11/483; E04G 11/48; E04G 9/02; E04C 2/384
USPC ..... 403/402, 403; 52/656.6, 656.9, 657
See application file for complete search history.

(56) References Cited

U.S. PATENT DOCUMENTS 484,293 A * 10/1892 Butcher ..... E06B 9/52 160/374
2,049,925 A * 8/1936 Rafter ..... E04C 2/384 52/657
2,101,349 A * 12/1937 Sharp ..... E06B 3/9682 403/280
2,336,253 A * 12/1943 William ..... E04G 9/06 249/190
2,703,159 A * 3/1955 Fleet ..... E06B 3/9682 52/656.5
2,767,814 A * 10/1956 Johnson ..... E06B 7/2309 52/204.599
2,801,454 A * 8/1957 Troiel ..... E04G 9/06 249/190

(Continued)

FOREIGN PATENT DOCUMENTS

CN 1135780 11/1996
CN 101120146 2/2008

(Continued)

*Primary Examiner* — Michael Safavi
(74) *Attorney, Agent, or Firm* — Wei & Sleman LLP

(57) ABSTRACT

A support structure for a frame formwork panel including a support structure and a formwork skin connected to the support structure, the support structure having two longitudinal edge girders and two transverse edge girders, wherein a corner connecting piece which is welded to the two respective edge girders is provided in at least some of the corner regions of the support structure where a longitudinal edge girder and a transverse edge girder come together.

18 Claims, 7 Drawing Sheets

(56) References Cited

U.S. PATENT DOCUMENTS 3,357,673 A * 12/1967 Williams ..... E04G 9/08 249/194
3,912,407 A * 10/1975 Heininger ..... F16B 7/00 403/205
3,914,062 A * 10/1975 Heininger ..... B23K 33/00 403/231
4,105,352 A * 8/1978 Holdiman ..... E06B 1/6015 160/381
4,513,554 A * 4/1985 Johnson ..... E06B 3/4636 403/205
5,092,093 A * 3/1992 Lu ..... E04G 9/06 249/135
5,870,868 A * 2/1999 Kita ..... F24F 13/32 52/309.9
6,032,980 A * 3/2000 Rapp ..... B60R 21/131 280/756
6,108,997 A * 8/2000 Blais ..... E06B 3/9645 160/371
2002/0117598 A1* 8/2002 Ward ..... E04G 17/045 249/47
2006/0157636 A1* 7/2006 Bogensberger ..... E04G 9/06 249/189
2016/0319558 A1* 11/2016 Lee ..... A47B 13/003
2017/0022724 A1* 1/2017 Laures ..... E04G 17/002
2019/0383041 A1* 12/2019 McCracken ..... E04G 13/04

FOREIGN PATENT DOCUMENTS

CN 102667030 9/2012
CN 207920061 9/2018
DE 8814302 U1 6/1989
DE 4412753 A1 * 10/1995 ..... E04G 9/02
DE 10037193 A1 9/2001
DE 102015223764 A1 6/2017
EP 0381000 A1 * 8/1990 ..... E04C 2/044
EP 0735212 A2 * 10/1996 ..... E04G 9/02
EP 1990483 A2 * 11/2008 ..... E04G 17/042
GB 1591300 A 6/1981
JP 05280127 A * 10/1993
JP 07247678 A * 9/1995
JP H1029060 2/1998
WO 2017093221 6/2017

* cited by examiner

SUPPORT STRUCTURE FOR A FRAME FORMWORK PANEL

FIELD OF THE INVENTION

The invention relates to a support structure for a frame formwork panel comprising a support structure and a formwork skin connected to the support structure, the support structure having two longitudinal edge girders and two transverse edge girders.

BACKGROUND OF THE INVENTION

Support structures with two longitudinal edge girders and two transverse edge girders for frame formwork panels are known in a large number of configurations. In the known support structures, the edge girders mentioned are mostly welded to one another at the four corner regions of the support structure. These welded regions must be able to transmit large forces. Support structures in which oblique struts have been welded in at the corner regions are known as well. However, this is complex in the production process, and the support structures of this type cannot be used as universally as those without oblique struts.

SUMMARY OF THE INVENTION

The object of the invention is to provide an improved support structure.

The support structure for a frame formwork panel according to the invention has a support structure and a formwork skin connected to the support structure, the support structure having two longitudinal edge girders and two transverse edge girders. According to the invention, a corner connecting piece which is welded to the two respective edge girders is provided in at least some of the corner regions of the support structure where a longitudinal edge girder and a transverse edge girder come together.

The support structure according to the invention can be used for frame formwork panels for the pouring of concrete, in particular ceiling formwork panels. It can also, however, be used for other formwork such as the absorption of the lateral load of an earth slope or for the temporary underpinning of a ceiling structure during repair work.

The two longitudinal edge girders and the two transverse edge girders of the support structure may be formed from metal only. The longitudinal edge girders and/or the transverse edge girders of the support structure may be extruded profiles made of aluminum. Rolled profiles made of steel or aluminum are possible as well. Profiles made of folded aluminum sheeting or sheet steel are possible as well.

In this application, the term "aluminum" is intended to include both unalloyed aluminum and aluminum alloys.

The support structure according to the invention prefers corner connecting pieces which easily fit into the overall support structure design. It is also possible according to the invention to produce the support structure together with the corner connecting pieces to be welded in a particularly efficient manner.

In the support structure according to the invention, it is possible for the two longitudinal edge girders and the two transverse edge girders to each have, on their rear side, a flange projecting toward the center region of the support structure and for the corner connecting pieces to be welded to the two flanges of the two edge girders coming together at the respective corner of the support structure. This positioning of the respective corner connecting pieces and this welding to the edge girder flanges results in a very stable corner connection, simply formed corner connecting pieces and welds which are favorable in terms of production. The respective corner connecting piece can rest either on the front sides facing the formwork skin side of the support structure or on the rear sides of the two flanges of the two respective edge girders facing away from the formwork skin side of the support structure.

The corner connecting pieces to be welded can each be a metal piece, which can preferably be positioned substantially parallel to the front of the support structure and/or the formwork skin. In one embodiment, the metal piece is formed with two legs that are perpendicular to one another or that substantially consists of two legs that are perpendicular to one another.

In the support structure according to the invention as disclosed in the previous part of the description, there is the possibility that in at least some of the corners of the support structure, at least one of the flanges of the two edge girders coming together there has a recess which can be welded to the corner connecting piece there. The recess may be located at an edge of the respective flange. The recess may be located on a miter surface of the respective flange. The embodiments described in this paragraph create a good basis for welding the two edge girder ends coming together in the rear region of the edge girders in a manner that is simple in terms of production.

In the support structure according to the invention, in particular as it has been disclosed in the previous part of the description, there is the possibility with at least one of the four edge girders, preferably with the two longitudinal edge girders, that at least one positioning piece is provided at a point located between the two ends of this edge girder, which is welded to this edge girder and that is provided to improve the possibility of attaching a formwork prop there. In cases where the respective edge girder has a flange as mentioned above, the at least one positioning piece may be welded to this flange. The positioning piece may be an angled component, which makes it easier to weld it to the respective edge girder.

In the support structure according to the invention as disclosed in the previous part of the description, there is the possibility that in at least one of the following welded connection positions a) a welded connection between the longitudinal edge girder and the corner connecting piece;

b) a welded connection between the transverse edge girder and the corner connecting piece;

c) a welded connection in the region of the miter surfaces of two edge girders coming together there, a welded connection is configured as a plug weld connection or as a recess weld at least once.

According to the invention, it is possible in the case of the plug weld connection position(s) a) and b) that the plug weld connection is formed with a hole in the flange of the respective edge girder. The at least one plug weld connection can be formed with an elongated hole.

The hole or elongated hole required for creating the plug weld connection and/or the elongated plug weld connection can be provided in the region of the remaining support structure to which part the respective corner connecting piece or the respective positioning piece is to be welded. The hole or the elongated hole may be formed in the flange of the respective edge girder referenced above.

In the support structure according to the invention as disclosed in the previous part of the description, at least one of the corner connecting pieces and/or possibly at least one of the positioning pieces may each have at least one positioning lug to facilitate the attachment of a formwork prop there. At least one of the corner connecting pieces may have three positioning lugs, one each in the region of a leg of the corner connecting piece and one in the interior angle region of the two legs of the corner connecting piece. The positioning lugs make it easier to position a formwork prop there because they identify a specific attachment position for the region of engagement of the prop head.

In the support structure according to the invention as disclosed in the previous part of the description, there is the possibility of forming at least one of the corner connecting pieces and/or possibly at least one of the positioning pieces in such a way that it is positioned, possibly with the exception of its at least one positioning lug, behind the flange of the respective edge girder mentioned above or behind the flanges of the respective two edge girders mentioned above when facing the rear of the support structure as a whole. As a result, the support structure can be used and operated in the same way as if there were no corner connecting pieces and no positioning pieces.

At this point, it is pointed out that the corner connecting pieces welded to the edge girders provide a very welcome multi-functionality in a very simple manner. They allow for an extremely stable connection of the edge girders of the support structure at the corners of the support structure, they reinforce the support structure in the corner regions and they provide a positioning aid when attaching a prop head of a formwork prop.

The support structure according to the invention as disclosed in the previous part of the application may furthermore have transverse intermediate girders which run parallel to the transverse edge girders and extend from the longitudinal edge girders to the longitudinal edge girders. The transverse intermediate girders may each be welded to the two longitudinal edge girders.

Another object of the invention is a frame formwork panel that comprises a support structure as disclosed in the previous part of the description and a formwork skin connected to the support structure at the front of the support structure. The advantages of the support structure according to the invention described are then provided by the frame formwork panel.

Another object of the invention is a method for producing a support structure as disclosed in the previous part of the description, characterized in that the longitudinal edge girders, the transverse edge girders, and the at least one corner connecting piece to be welded are placed in a welding device; and that the welded connections between the edge girders and the welded connections between said corner connecting pieces and the edge girders are fashioned from the rear of the support structure.

It may be provided in the method according to the invention that at least some of the welded connections are fashioned by a respective flange hole or through a respective flange recess.

If the support structure to be produced has transverse intermediate girders, these can also be inserted into the welding device. The longitudinal edge girders can be welded before or simultaneously with or after the corner connecting pieces are welded.

In the method, the longitudinal edge girders, the transverse edge girders and the at least one corner connecting piece to be welded can each be inserted into the welding device with their "rear side up" and then welded comfortably from above. One option is to place the corner connecting pieces to be welded in the welding device, place the four edge girders lying on these corner connecting pieces "rear side up" in the welding device, and then weld these corner connecting pieces and the edge girders together from above. It is also possible, however, to reverse the order, i.e., first insert the edge girders into the welding device "rear side up," insert the corner connecting pieces to be welded at the respective corner regions into a space between the front sides of the aforementioned flanges of the edge girder and a contact surface for the respective corner connecting piece, and then perform the welding. At the same time the corner connecting pieces are welded; the welds on the flange miter surfaces referenced above are fashioned as well. The same applies, if necessary, to the welding of the positioning pieces. At a reasonable point in time, transverse intermediate girders of the support structure, which run parallel to the transverse edge girders and extend from one longitudinal edge girder to the next, may be inserted into the welding device and welded to the longitudinal edge girders.

The welding device is designed in such a way that it has support surfaces and stops so that all inserted parts are in a safe, positionally accurate position for the gas welding process.

The welds can be carried out in the welding device in an automated manner, for example with welding robot(s). The components of the support structure can also be inserted into the welding device at least in part by means of an insertion robot.

Another object of the invention is a support structure for a frame formwork panel, which can be produced by the method according to the invention.

BRIEF DESCRIPTION OF THE DRAWINGS

The invention and more specific embodiments of the invention are explained in more detail below on the basis of an exemplary embodiment shown in the drawings. The figures show the following.

DETAILED DESCRIPTION

Figure 1:
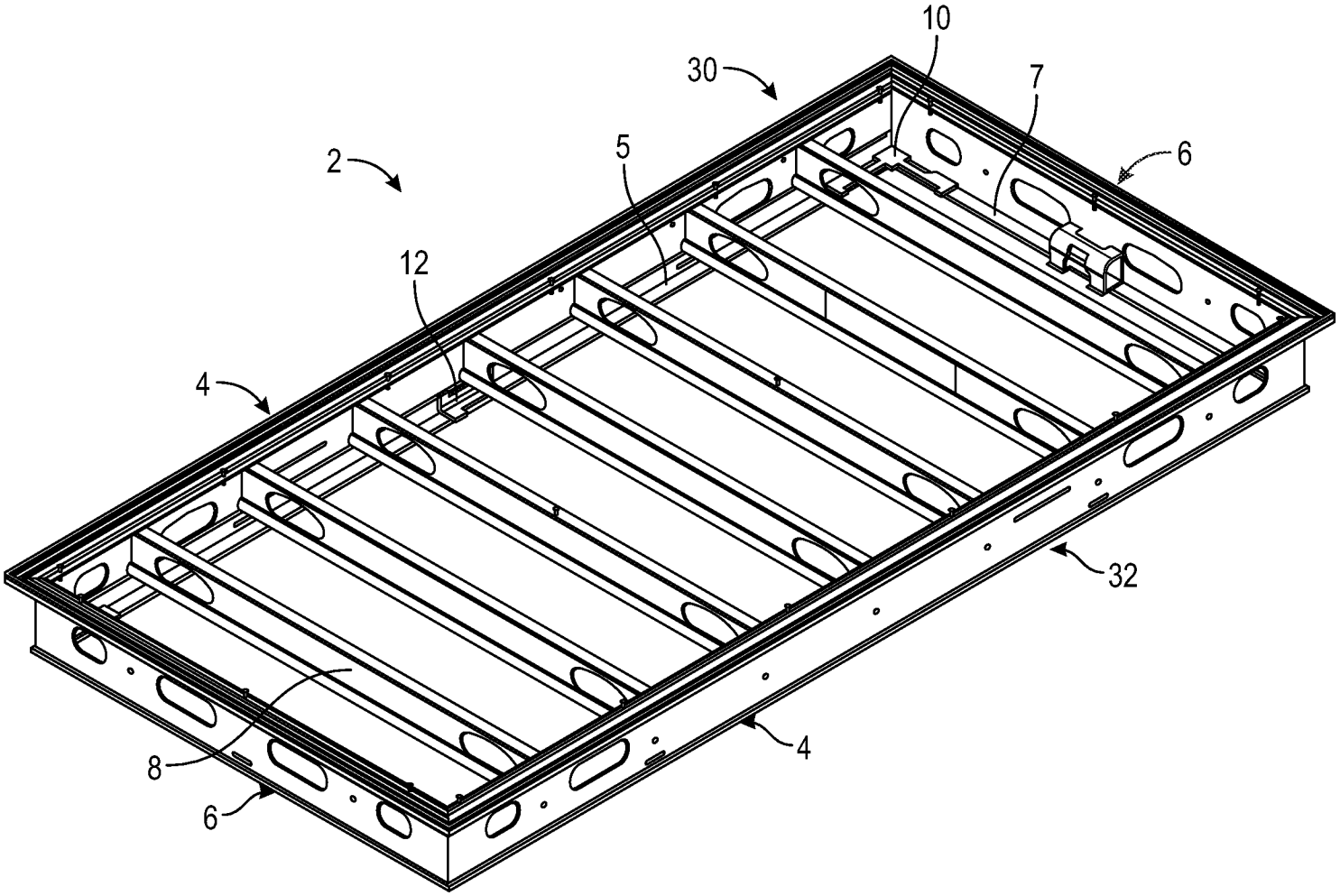
FIG. 1 a support structure, in a perspective representation and looking obliquely from above onto the front of the support structure.

The support structure 2 shown in FIG. 1 is constructed from two longitudinal edge girders 4, two transverse edge girders 6 and seven transverse intermediate girders 8. The transverse edge girders 6 are positioned perpendicular from the longitudinal edge girders 4. The transverse intermediate girders 8 run parallel to the transverse edge girders 6 and extend from one longitudinal edge girder 4 to the other longitudinal edge girder 4.

FIG. 1 furthermore shows a corner connecting piece 10 and a positioning piece 12. Three further corner connecting pieces 10 and a further positioning piece 12 are covered by the edge girders 4 and 6.

It can be seen that the longitudinal edge girders 4 and the transverse edge girders 6 each have, at the rear end, a flange 5 and/or 7 projecting towards the center region of the support structure 2.

Figure 2:
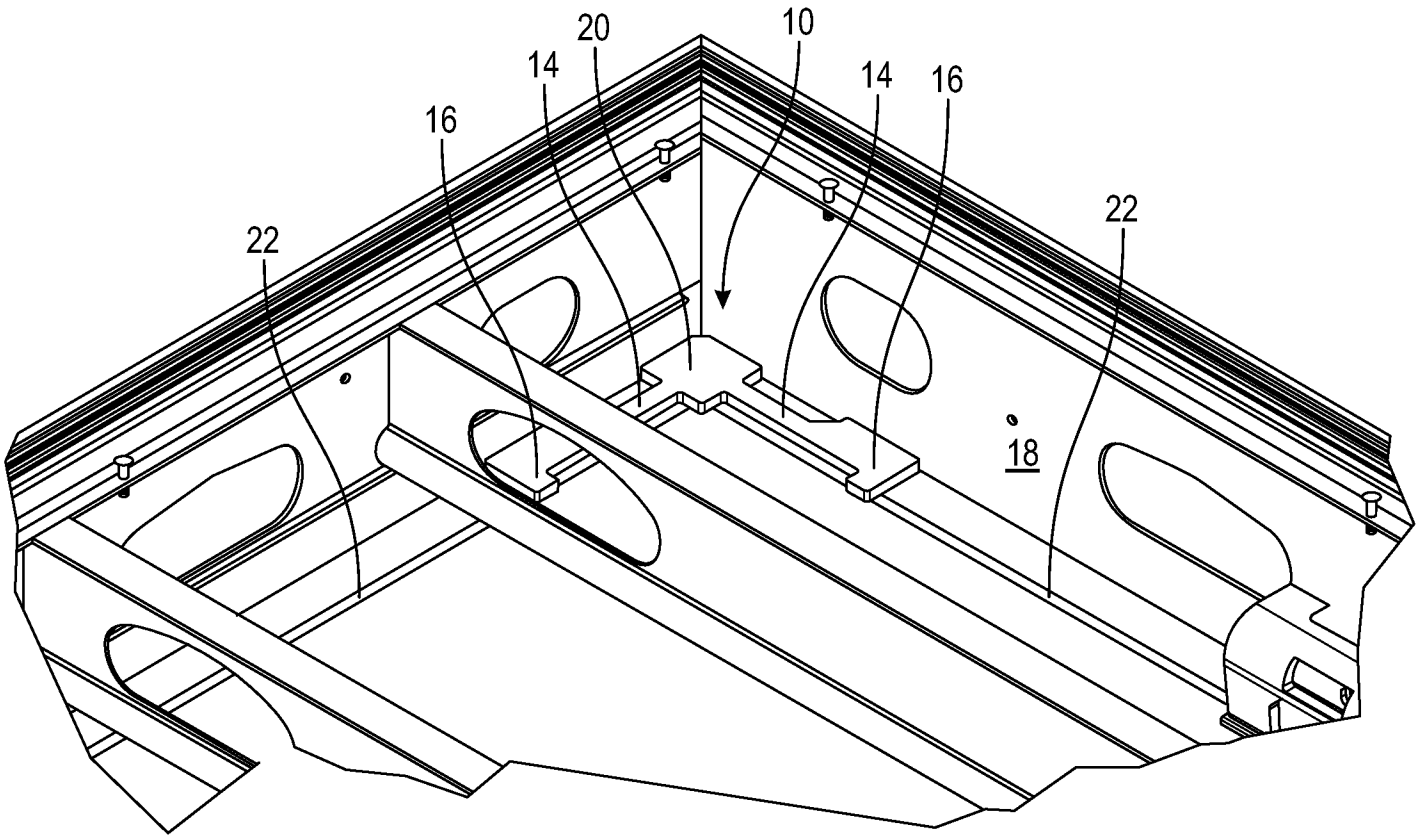
FIG. 2 the upper corner of the support structure in FIG. 1, on a larger scale.
Figure 6:
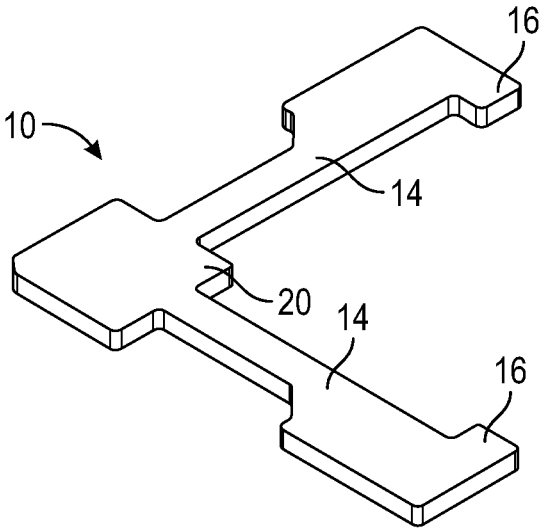
FIG. 6 a corner connecting piece, in a perspective representation and on a larger scale.

FIG. 2 shows more clearly that the corner connecting piece 10 is a metal piece with two legs 14 running perpendicular to one another. At each end of a leg 14, the corner connecting piece 10 has a lug 16, which faces away from the member 18 of the edge girder 4 and/or 6 and projects toward the interior of the support structure 2 in relation to the respective leg 14. The corner connecting piece 10 has a further lug 20 in its interior angle region, from where the two legs 14 originate, which projects towards the interior of the support structure 2 in relation to the legs. The lugs 16 and 20 each project a little above the inner edge 22 of the respective flange 5 and/or 7. The corner connecting piece 10 is shown in FIG. 6 again, now detached from the edge girders 4 and 6.

Figure 7:
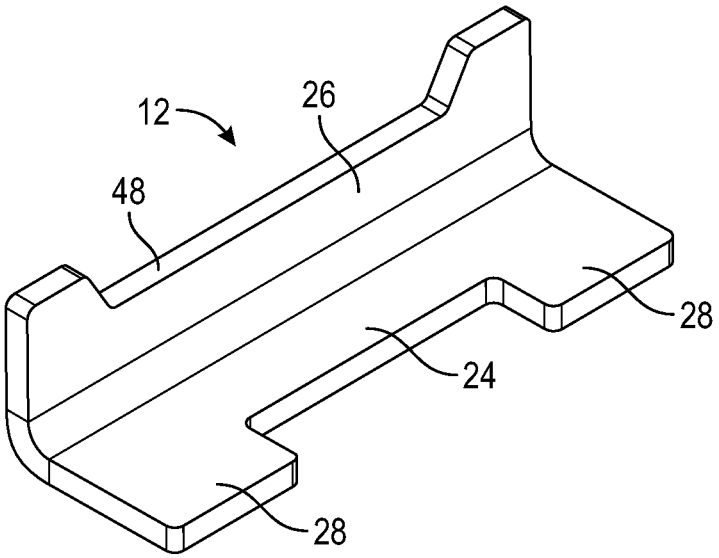
FIG. 7 a positioning piece, in a perspective representation and on a larger scale.

The positioning piece 12 shown in FIG. 1 is partially covered by one of the transverse intermediate supports 8. FIG. 7 shows the entire positioning piece. It can be seen that the positioning piece 12 has an angular shape, a first leg 24 of the positioning piece 12 resting on the forward-facing surface of the flange 5 of the respective longitudinal edge girder 4, while the second leg 26 rests on the inside of the member 18 of the respective longitudinal edge girder 4. The first leg 24 has a lug 28 at each of its two ends, a part of which projects beyond the inner edge 22 of the flange 5 toward the interior of the support structure 2. In FIG. 7, the positioning piece 12 is drawn by itself, detached from the support structure 2.

Figure 3:
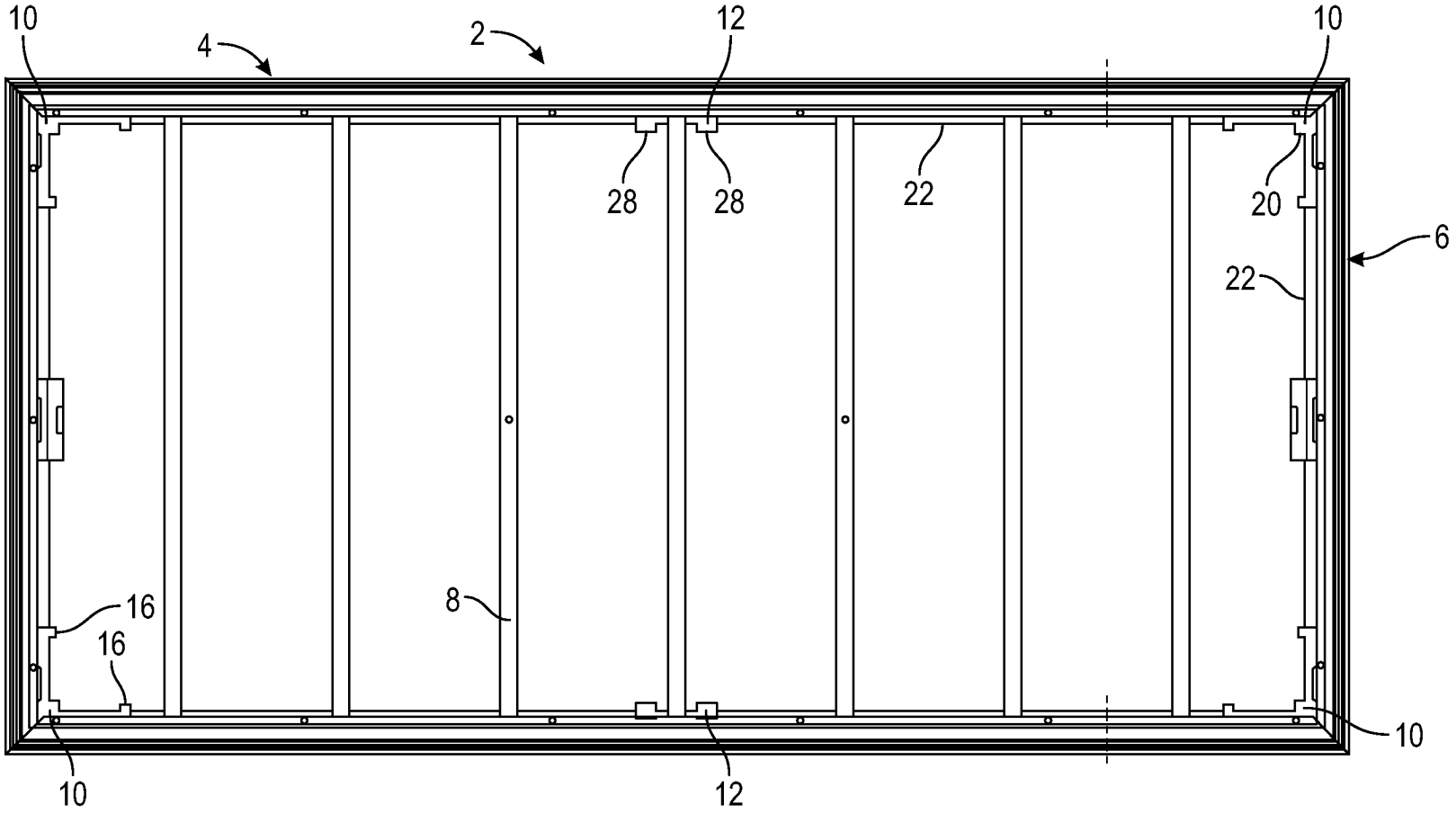
FIG. 3 a top view of the rear of the support structure from FIG. 2, now not in a perspective view.

FIG. 3 illustrates that there are a total of four corner connecting pieces 10 and two positioning pieces 12 for the support structure 2 in the illustrated exemplary embodiment. FIG. 3 shows again how the lugs 16 of the corner connecting pieces 10 and the lug 28 of the positioning pieces 12 project beyond the respective inner edge of the respective longitudinal edge girder 4 and/or the respective transverse edge girder 6.

Figure 4:
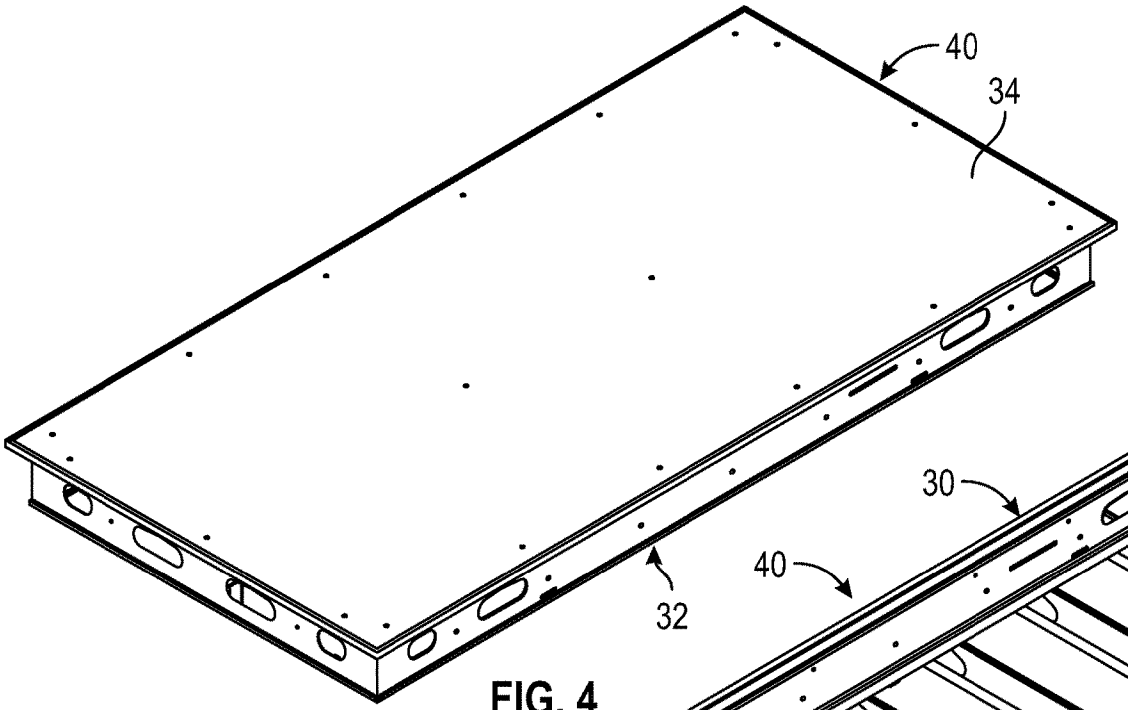
FIG. 4 a formwork panel containing a support structure according to FIG. 1, in a perspective representation and looking obliquely from above onto the formwork skin of the formwork panel.

FIG. 4 illustrates how a formwork skin 34 is arranged on the front side 30 of the support structure and fastened to the support structure 2. The support structure 2 and the formwork skin 34 together form a formwork panel 40. The rear side of the support structure is designated with the reference number 32.

Figure 5:
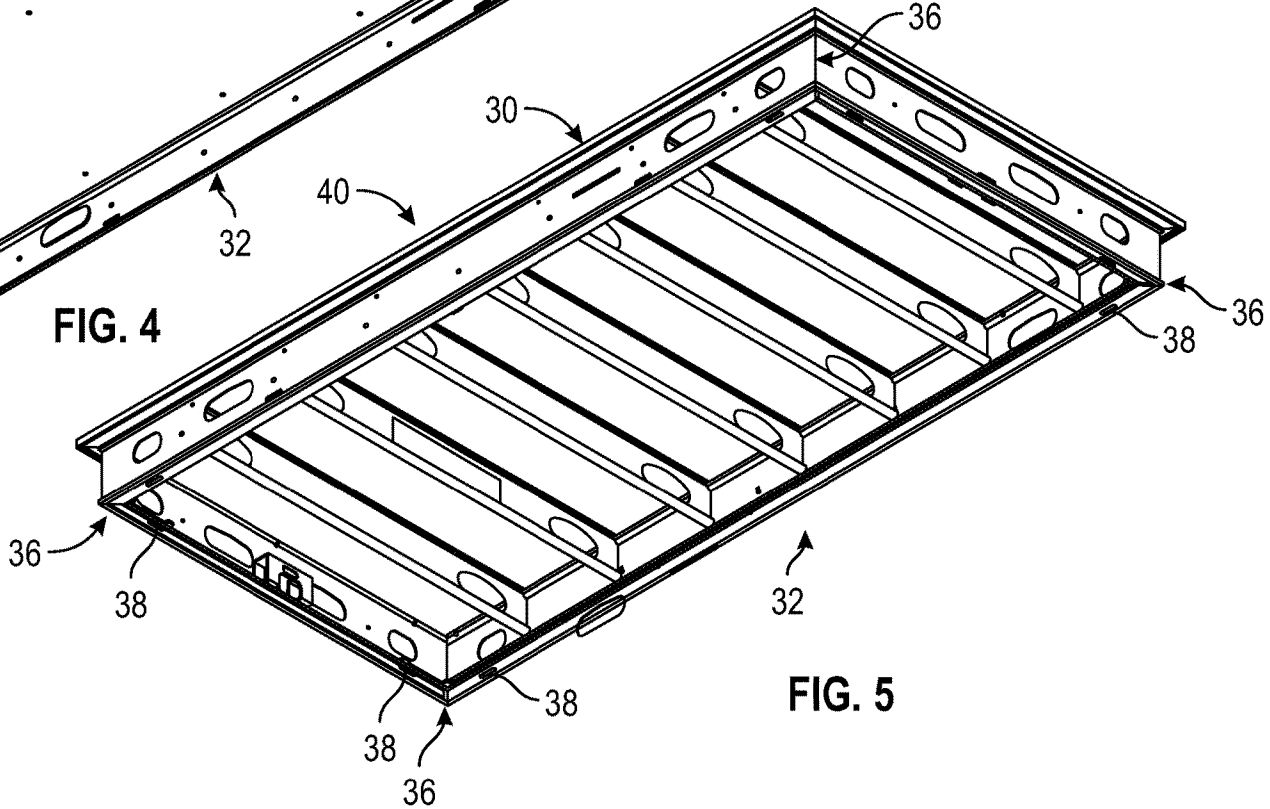
FIG. 5 the formwork panel or its support structure from FIG. 4, in a perspective representation and looking obliquely from below onto the rear of the support structure or the formwork panel.

FIG. 5 shows that an elongated hole 38 is provided in each of the four corner regions 36 of the support structure 2 in the flanges 5 and 7 of the two edge girders 4 and 6, which come together at the corner region 36. The elongated holes 38 are each present at a location that makes it possible for the corner connecting piece 10, positioned at the front of the respective flange 5 and/or 7, to cover the elongated hole 38 with its leg end region; also refer to FIGS. 8 and 9. A weld seam can be placed in each of these eight elongated holes 38, which substantially fills the respective elongated holes 38 and produces a weld between the respective corner connecting piece 10 and the respective flange 5 or 7.

Recesses, preferably edge recesses, can be provided in the flanges 5 and 7 instead of the elongated holes 38. Then it is possible to weld in the space formed by the respective recess up to the corner connecting piece 10.

Figure 8:
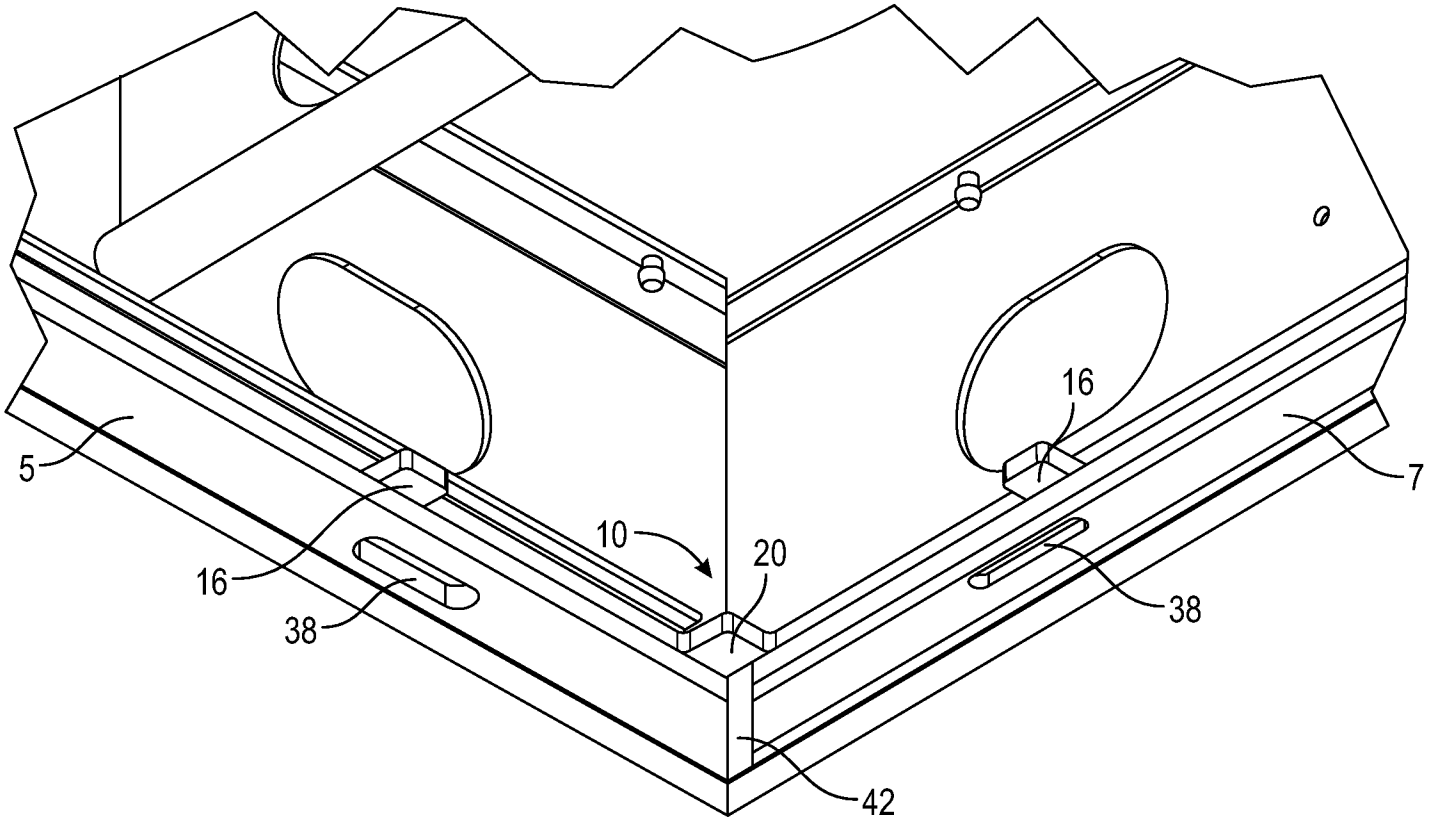
FIG. 8 a section of the support structure from FIG. 1, showing a corner region, in a perspective representation from obliquely below, with no welding having been performed yet.
Figure 9:
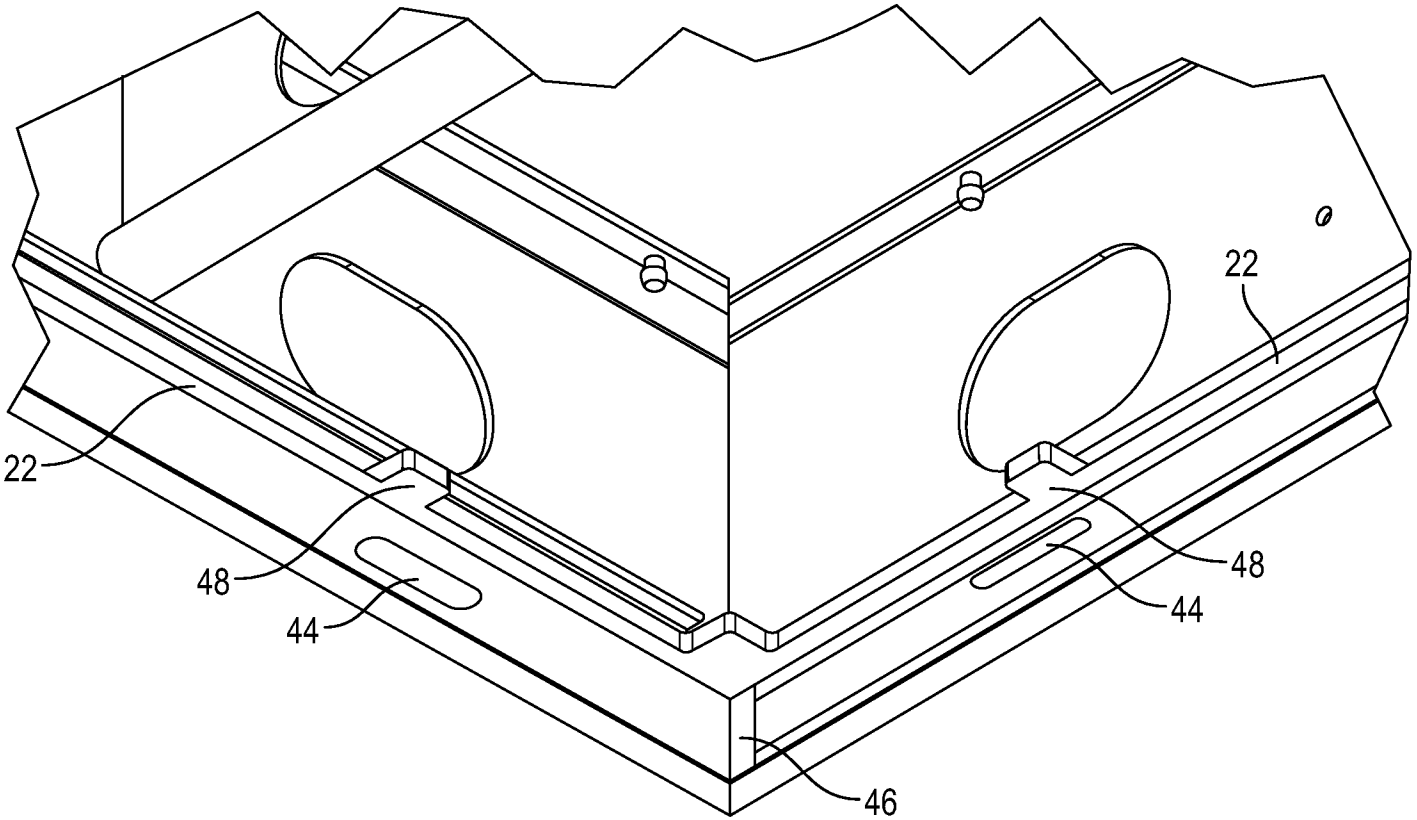
FIG. 9 the same section of the support structure as in FIG. 8 but now after the welding has been performed.

FIGS. 8 and 9 show that there is a recess 42 in the flanges 5 and/or 7 at the four corners of the support structure 2 at the end of one of the two edge girders 4 and/or 6 that come together there. This recess 42 represents a free space in which a weld seam can be placed, which welds the ends of the two edge girders 4 and 6 coming together there at the flanges 5 and/or 7 and extends in depth to the inner angular region of the respective corner connecting piece 10.

FIG. 9 illustrates the state after the welding step described has been performed. It shows the weld seams 44 in the elongated holes 38 and the weld seam 46 in the recess 42. It can also be seen that weld seams 48 can additionally be fashioned from the rear side 32 of the support structure 2 at the transition between the lugs 16 and/or 20 and the respective end edge 22 of the respective flanges 5 and/or 7.

In the illustrated embodiment, the two positioning pieces 12 are not welded to the respective longitudinal edge girder 4 by means of a plug weld. Instead, there is a weld seam on the longitudinal edge 48 of the second leg 46 of the positioning piece 24, which lies against the member 18 of the respective longitudinal edge girder 4 and this member 18.

To carry out the welds between the edge girders 4 and/or 6 and the corner connecting pieces 10, the edge girders 4 and 6 and the corner connecting pieces 10 are inserted in a welding device "rear side up" in the correct position. To this purpose, one option is to insert the corner connecting pieces 10 first and to then position the edge girders 4 and 6 above them. Another option is to first insert the edge girders 4 and 6 "rear side up" and to then insert the corner connecting pieces 10 (rear side up) below the front sides of the flanges 5 and/or 7, with the welding device providing support surfaces for the front sides of the corner connecting pieces 10. The welds described can then be carried out on the one hand between the legs 14 of the corner connecting pieces 10 and the flanges 5 and/or 7 of the edge girders 4 and 6 and on the other hand between the end of the respective flange 5 and/or 7 with the recess 42 and the corner region of the corner connecting piece 10. The welds referenced can be conveniently carried out from above from the rear of the support structure 2. The support structure 2 does not have to be repositioned or turned for these welds.

The invention claimed is:

1. A support structure for a frame formwork panel, the support structure comprising:

two longitudinal edge girders comprising at least a first longitudinal edge girder and two transverse edge girders comprising at least a first transverse edge girder, wherein the two longitudinal edge girders and the two transverse edge girders each define, on respective rear sides, a flange projecting toward a center region of the support structure;

a corner connecting piece, connected by welded connection to the flange of the first longitudinal edge girder and the flange of the first transverse edge girder, disposed in at a corner region of the support structure where the first longitudinal edge girder and the first transverse edge girder meet, wherein in at least one of the following weld connection positions:

a) the welded connection between the longitudinal edge girder and the corner connecting piece;

b) the welded connection between the transverse edge girder and the corner connecting piece; or c) the welded connection in a region of miter surfaces of the first longitudinal edge girder and the first transverse edge girder, the welded connection is configured as a plug weld connection or as a recess weld, at least one of the flanges defining a recess at an edge of the flange and/or in the case of the plug weld joint position(s) a) and b), the plug weld joint defines a hole in the flange of the first transverse edge girder or the first longitudinal edge girder.

2. The support structure according to claim 1, wherein the corner connecting piece is welded to the two flanges of the two edge girders coming together at the respective corner of the support structure.

3. The support structure according to claim 2, wherein the corner connecting piece rests on a front side facing a formwork skin side of the support structure or on a rear side of the two flanges of the two respective edge girders facing away from the formwork skin side of the support structure.

4. The support structure according to claim 1, wherein the corner connecting piece is a metal piece with two legs that are perpendicular to each other.

5. The support structure according to claim 2, wherein in at least one corner of the support structure, at least one of the flanges of the two edge girders defines a recess which can be welded to the corner connecting piece.

6. The support structure according to claim 2, wherein in at least one corner of the support structure, the flange of the two edge girders comprises miter surfaces; and that a recess is provided on the miter surface of one of the flanges.

7. The support structure according to claim 1, wherein at least one positioning piece is provided at a point located between two ends of one of the two longitudinal edge girders or the transverse edge girder for attaching a formwork prop.

8. The support structure according to claim 7, wherein the at least one positioning piece is welded to the flange of the one of the two longitudinal edge girders or the transverse edge girder.

9. The support structure according to claim 1, wherein with the hole defines an elongated hole.

10. The support structure according to claim 1, wherein the corner connecting piece has at least one positioning lug to facilitate attachment of a formwork prop.

11. The support structure according to claim 10, wherein the corner connecting piece comprises two legs and comprises three positioning lugs, wherein a first lug of the three positioning lugs is in a region of a first leg of the two legs, wherein a second lug of the three positioning lugs is in a region of a second leg of the two legs, and wherein a third lug is positioned in the interior angle region of the two legs of the corner connecting piece.

12. The support structure according to claim 11, wherein the three positioning lugs project beyond an inner edge of the respective flange of the respective two edge girders when viewed from a front of the support structure.

13. The support structure according to claim 1, wherein the two longitudinal edge girders and/or the two transverse edge girders are extruded profiles made of aluminum.

14. A frame formwork panel, comprising:

a support structure according to claim 1 and a formwork skin at a front of the support structure that is connected to the support structure.

15. A method for creating a support structure according to claim 1, wherein the two longitudinal edge girders, the two transverse edge girders, and the corner connecting piece to be welded are placed in a welding device; and that welded connections between the edge girders and the welded connections between said corner connecting pieces and the edge girders are fashioned from a rear of the support structure.

16. The method according to claim 15, wherein at least some of the welded connections are fashioned by a respective flange hole or through a respective flange recess.

17. A support structure for a frame formwork panel, fashioned with the method according to claim 15.

18. A support structure for a frame formwork panel, the support structure comprising:

two longitudinal edge girders comprising at least a first longitudinal edge girder;

two transverse edge girders comprising at least a first transverse edge girder, wherein the two longitudinal edge girders and the two transverse edge girders each define, on respective rear sides, a flange projecting toward a center region of the support structure;

a corner connecting piece, connected by welded connection to the flange of the first longitudinal edge girder and the flange of the first transverse edge girder, disposed at a corner region of the support structure where the first longitudinal edge girder and the first transverse edge girder meet, wherein in at least one of the following weld connection positions:

a) the welded connection between the longitudinal edge girder and the corner connecting piece;

b) the welded connection between the transverse edge girder and the corner connecting piece; or c) the welded connection in a region of miter surfaces of the first longitudinal edge girder and the first transverse edge girder, the welded connection is configured as a plug weld connection or as a recess weld, at least one of the flanges defining a recess at an edge of the flange and/or in the case of the plug weld joint position(s) a) and b), the plug weld joint defines a hole in the flange of the first transverse edge girder or the first longitudinal edge girder.

* * * * *